United States Patent [19]

Morello et al.

[11] 3,954,260

[45] May 4, 1976

[54] PAPER MONEY DISPENSING MECHANISM

[75] Inventors: Herbert Morello, North Canton; George S. Mountford, Chippewa Lake Village; Richard E. Keck, Akron, all of Ohio

[73] Assignee: Diebold, Incorporated, Canton, Ohio

[22] Filed: Feb. 13, 1975

[21] Appl. No.: 549,850

[52] U.S. Cl. ..... 271/12; 271/96; 271/30 R; 271/118; 271/263; 271/272

[51] Int. Cl.[2] ..... B65H 5/08

[58] Field of Search ..... 209/73; 271/94, 96, 271/30 R, 64, 118, 262, 263, 272, 11, 12

[56] References Cited

UNITED STATES PATENTS 2,220,073 11/1940 Belcher et al. ..... 271/96

*Primary Examiner*—Allen N. Knowles

*Attorney, Agent, or Firm*—Frease & Bishop

[57] ABSTRACT

A rotary suction device selectively removes individual paper money or currency bills or banknotes endwise from a stack or bundle thereof and delivers each removed bill endwise to conveyor means which successively, individually transports the bills to a dispensing station. Sensor means detects the presence of multiple bills on the suction rotor during removal from the stack; and, before delivery of any bills in multiple to the conveyor means, the multiple bills are rejected and bypass-discharged directly from the suction rotor to a reject station. A plurality of rotary suction devices may be installed side by side to deliver bills in various denominations, such as 1, 5, 10 and 20 dollar bills.

20 Claims, 26 Drawing Figures

PAPER MONEY DISPENSING MECHANISM

BACKGROUND OF THE INVENTION

1. Field of the Invention

The invention relates to cash dispensing apparatus which delivers selected amounts of currency in paper money, bill or bank-note form to a dispensing station from a stored stack or bundle of bills contained in a magazine. More particularly, the invention relates to a simplified mechanism which endwise removes paper money bills one at a time from a stack thereof and delivers the bills individually, successively, to conveyor means which in turn transports the bills individually to a dispensing station.

Also, the invention relates to a rotary suction currency removal mechanism which selectively individually removes bills endwise from a supply stack of bills in a storage magazine, and which delivers such removed bills endwise individually to conveyor dispensing means from the rotary mechanism without delivering more than one bill at a time.

2. Description of the Prior Art

Prior cash dispensing apparatus for paper money bills, such as mechanisms shown in U.S. Pat. Nos. 3,077,983 and 3,760,158, which deliver bills from a stack thereof to a dispensing station have stored the bills in a magazine stack with the bills arranged on edge. The edge supported bills in the stack are removed from the stack by an oscillatory suction device that delivers the removed bills to conveyor means, arranged with the length of the bills extending transverse of the direction of bill travel along the conveyor means.

Such prior banknote delivery mechanisms are quite complicated in construction and operation. They have many moving parts which engage the bills. The adjustment and operation of the mechanisms and components must be critically controlled. Further, storing bills on edge and delivering the same with the bill length extending transverse of the direction of conveyor travel requires considerable lateral space in the dispenser housing.

Such lateral space requirements are undesirable, particularly where a dispensing mechanism is desired for dispensing multiple denominations of bills, for example, four different denominations, such as 1, 5, 10 and 20 dollar bills.

Another inherent difficulty and undesirable characteristic of such prior cash dispensing devices is that the detector mechanism for detecting and sidetracking or rejecting bills removed in multiple, rather than individually, from the stack must be incorporated in and coordinated with the conveyor mechanism structure and operation. This complicates the provisions for accurately counting the number of bills delivered at the dispensing station, which counting is an absolute requirement for automatic banking equipment.

Other difficulties in prior structures involve the lack of firmly applying vacuum pick-up suction to an extended area of a bill in removing it from a stack, the lack of engaging the bill in a large area on driving it through the pick-up and dispensing mechanism, the lack of mechanism for holding the bill securely during measurement of its thickness to determine the presence or absence of a single bill, the lack of full bill length presentation for sensing bill thickness so that bill thickness measurements are unaffected by dog-eared bills. Further, prior devices for accuracy require stringent drive controls, speed controls, vacuum requirements, etc.

Thus, there exists a need for a simplified mechanism for effectively removing individual bills from a stack which involves relatively few moving mechanism parts contacting the bills during removal, as well as a minimum of moving parts, and which is compact and inexpensive in construction while retaining maximum security for the bills in the stack contained in the magazine; which mechanism may have a relatively low speed in relation to the output of bills removed from the stack and which handles the bills by simple rotary motions avoiding mechanical oscillation movements; which rotary movement of bills during removal from a stack permits extensive amplification of bill thickness measurements for sensing the existence of multiple bill removal at any one time from the stack; which mechanism avoids criticality in adjustment and operation; which mechanism removes the bills endwise from the stack and delivers the same individually to conveyor mechanism end to end; which mechanism bypasses bills removed from the stack in multiple so that bills in multiple are not delivered to the conveyor mechanism; and which mechanism eliminates or minimizes the stated difficulties or undesirable characteristics encountered in the construction and operation of prior devices.

SUMMARY OF THE INVENTION

Objectives of the invention include providing a selective currency removal rotor for individually removing endwise successive bills from a stack thereof stored in a magazine, and dealing the successively removed bills end to end from the rotor individually to conveyor means; providing such a rotary bill removal mechanism with sensor means which detects the removal of bills in multiple from a stack of stored bills and bypasses such multiple bills to a reject station before delivery to a conveyor mechanism; providing a mechanism for delivering or removing bills from a stack of bills in a magazine which avoids stacking or storing the bills on edge in the magazine; providing such a mechanism for removing bills individually, successively, endwise from a stack of bills stored in a magazine, and in which magazines may be installed in multiples side by side to accommodate the requirements of delivery of bills of different denominations; and providing such a mechanism having a simplified construction and operation, free of critical adjustments and controls, which is relatively low in cost and reliable in operation, which achieves the stated objectives in a safe, effective and easy serviced manner, and which solves problems and satisfies needs existing in the art.

These and other objects and advantages may be obtained by the new paper money dispensing mechanism of the invention, the general nature of which may be stated as including movably mounted magazine means storing a stack of bills to be dispensed as successive bills; rotary bill suction pick-up means including walls forming a hollow rotor; the rotor having an axis and a suction compartment, the rotor walls including a circumferential wall with an outer surface and elongated bill pick-up suction slot means formed in said circumferential wall communicating with the compartment and oriented generally in the direction of the rotor axis; main drive means for rotating the rotor; the rotary bill suction pick-up means also including a source of suction and means operatively connected with the main drive means for establishing intermittent communication between the suction source and compartment to establish selectively at the suction slot means conditions of suction "off" and suction "on"; bill peeler means normally engaged with said outer rotor surface operatively connected with the main drive means and selectively movable to a rotor disengaged position; bill conveyor means for successively conveying single bills to a dispense station as fed from the bill pick-up rotor; multiple bill sensor-rejector means operatively related to the rotor for sensing the absence or presence of the rotor surface of multiple bills picked up in multiple by the rotor, and operative to bypass multiple bills picked up in multiple to a reject station before and thereby to prevent delivery of multiple bills in multiple to said conveyor means; means for holding bills picked up by the rotor securely on the outer rotor surface at least during the multiple bill sensing operation of the multiple bill sensor-rejector means; means operatively connected with the main drive means and magazine means for moving the magazine means from a normal rotor disengaged position to a position to engage an end portion of the top bill in said stored stack of bills with the outer rotor surface; the operative connections between the main drive means, bill peeler means, magazine means and suction source of communication, being synchronized to establish conditions of suction on and bill peeler means disengaged position when the magazine is moved to engage an end portion of the top bill in the stored stack of bills with the outer rotor surface; and said operative connections also being synchronized to establish conditions of suction off, bill peeler engaged with outer rotor surface, and magazine means rotor disengaged position, after a bill picked up by the rotor suction pick-up means on rotor movement has been sensed by the multiple bill sensor-rejector means.

BRIEF DESCRIPTION OF THE DRAWINGS

Preferred embodiments of the invention - illustrative of the best modes in which applicants have contemplated applying the principles — are set forth in the following description and shown in the drawings and are particularly and distinctly pointed out and set forth in the appended claims.

FIG. 17 showing a neutral or at-rest position of the components,

FIG. 18 showing rotor movement 90° from FIG. 17,

FIG. 19 showing further 135° rotor movement,

FIG. 20 showing further 90° rotor movement,

FIG. 21 showing further 135° rotor movement, and delivery of a bill from the rotor to the conveyor mechanism, FIG. 22 showing completion of bill delivery to the conveyor means and showing the rotor returned to neutral position, FIG. 23 showing the parts in a position similar to FIG. 19 and showing multiple bill pick-up by the rotor, FIG. 24 showing sensing of multiple bill pick-up at a rotor position similar to FIG. 20, and FIG. 25 showing bypass discharge of multiple bills from the rotor directly to a reject station and before delivery of bills in multiple to the conveyor means.

Similar numerals refer to similar parts throughout the various figures of the drawings.

DESCRIPTION OF THE PREFERRED EMBODIMENTS

First Embodiment

Figure 16:
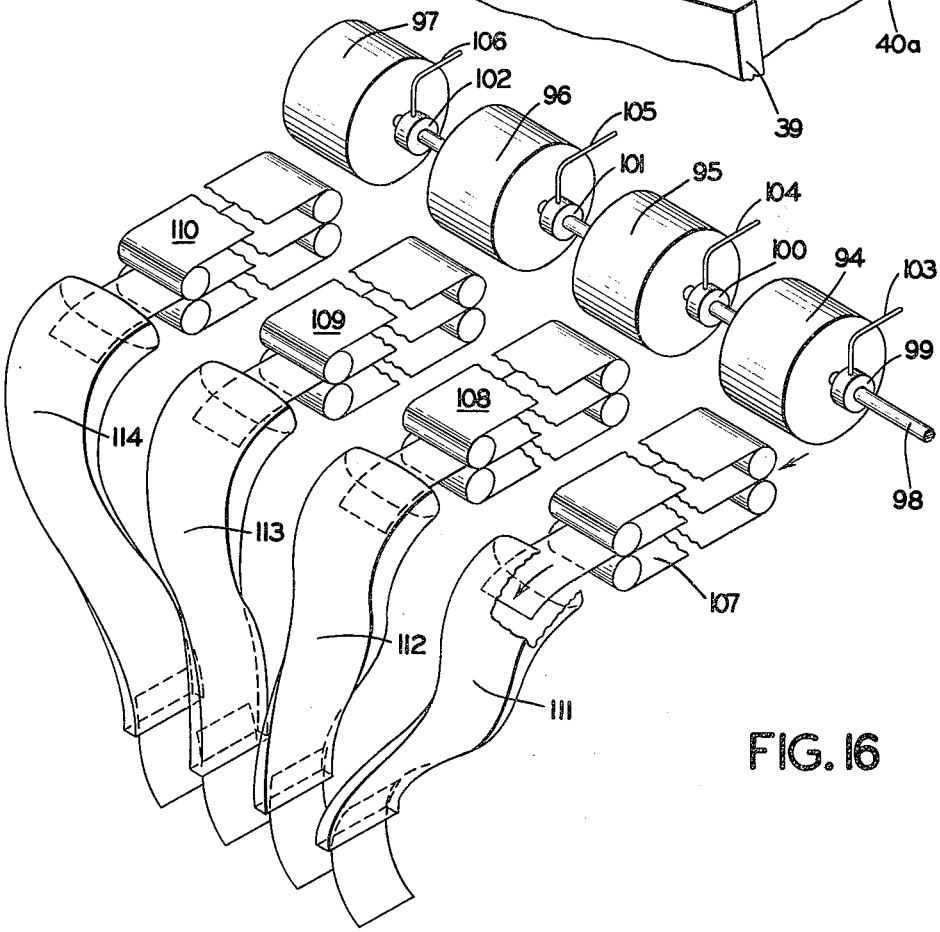
FIG. 16 is a diagrammatic view illustrating a plurality of dispensing mechanism rotors and conveyors installed side by side for delivering bills of various denominations to a dispensing station.

The construction and operation of a single rotary bill pick-up unit is shown generally in FIGS. 1 through 15 and the operation thereof is shown in FIGS. 17 through 25; while FIG. 16 shows another embodiment comprising a plurality of rotary pick-up mechanisms.

Figure 2:
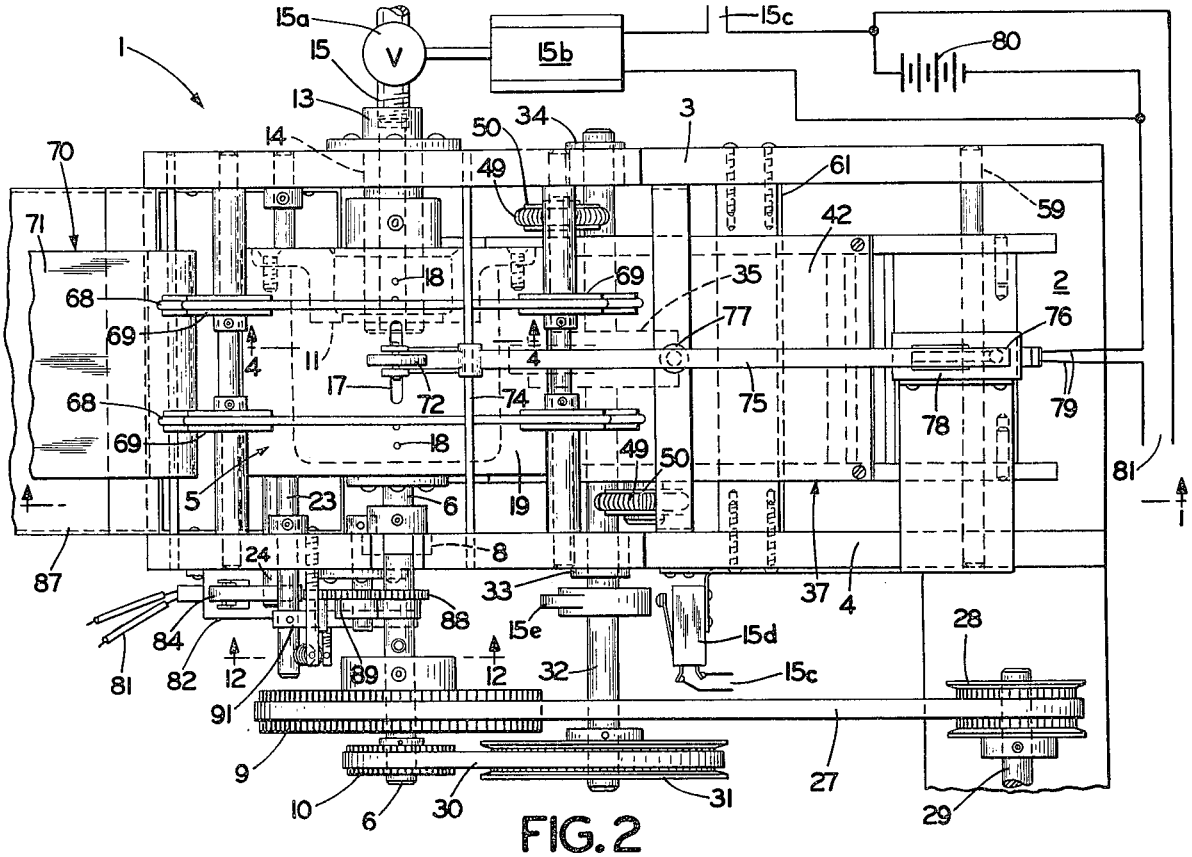
FIG. 2 is a top plan view of the mechanism shown in FIG. 1.
Figure 11:
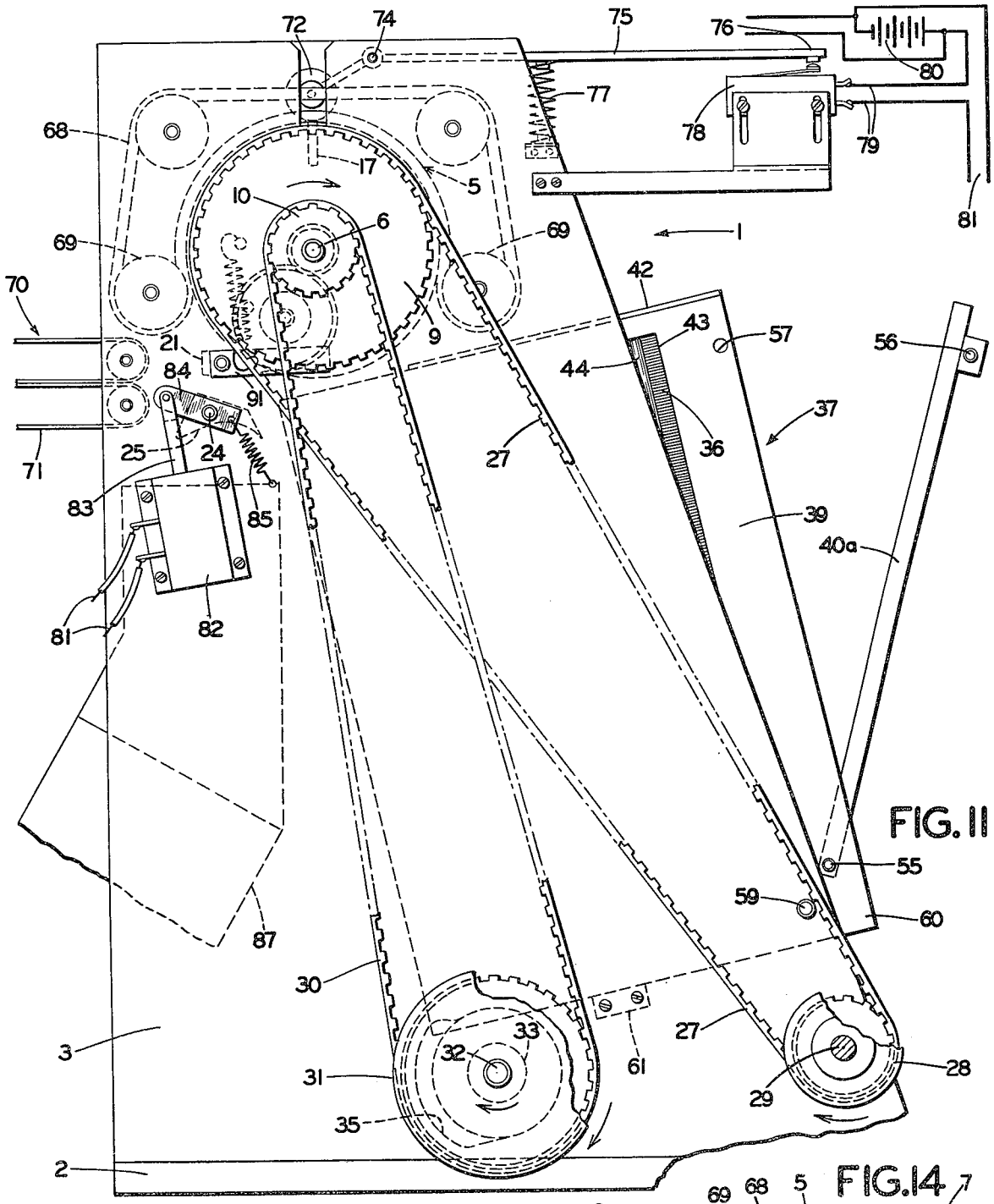
FIG. 11 is a side elevation with parts broken away of the mechanism shown in FIGS. 1 and 2.
Figure 12:
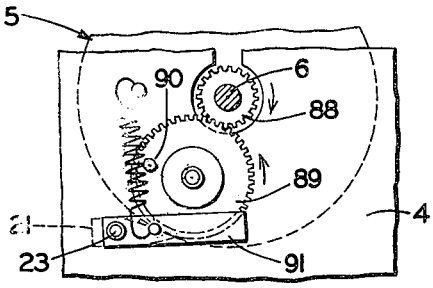
FIG. 12 is a fragmentary view looking in the direction of the arrows 12—12, FIG. 1, showing the control for the bill peeler in peeling position.
Figure 13:
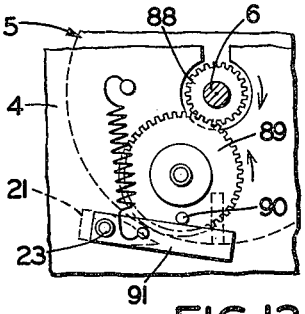
FIG. 13 is a view similar to FIG. 12 showing the rotor bill peeler control mechanism in bill pick-up position.

The improved rotary bill pick-up unit is indicated generally at 1 and may be mounted on a base 2 and spaced side support members 3 and 4. A hollow rotor 5 has a stub shaft 6 (FIG. 5) mounted on one rotor side wall 7, and the stub shaft 6 is journaled at 8 in the side support member 4. The stub shaft 6 may serve as a drive shaft for the rotor by mounting a drive gear 9 near the outer end thereof (FIGS. 2 and 11). A magazine control drive pinion 10 preferably is mounted on the end of stub shaft 6 adjacent gear 9.

The other rotor side wall may be formed by a hub 11 in which a bearing 12 is journaled. A fixed hollow shaft 13 is journaled in bearing 12 and extends through opening 14 inside support member 3 for connection at 15 (FIG. 2) with a suitable source of vacuum. In this manner, suction may be applied to the interior compartment 16 of hollow rotor 5.

Preferably, an elongated radial slot 17 and aligned openings 18 adjacent the ends of slot 17 preferably are provided in the peripheral rotor wall 19 to form a combined large suction area for bill pick-up later described. The hub 11 may be assembled by screws 20 to the rotor 5 for rotor maintenance, assembly and disassembly.

Figure 4:
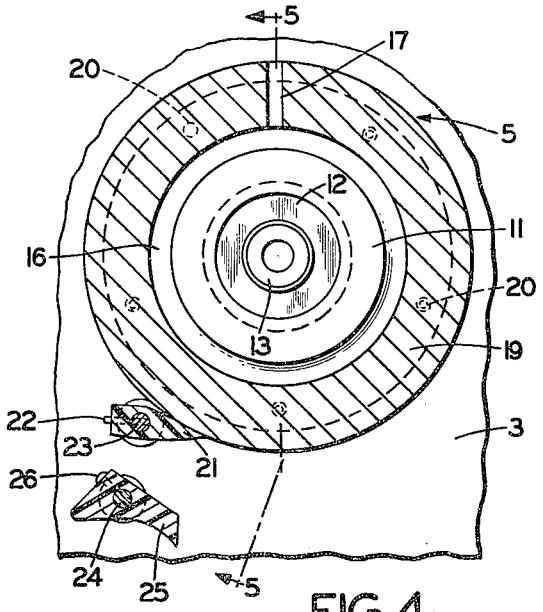
FIG. 4 is a fragmentary sectional view illustrating the rotor construction, taken on the line 4—4, FIG. 2.
Figure 5:
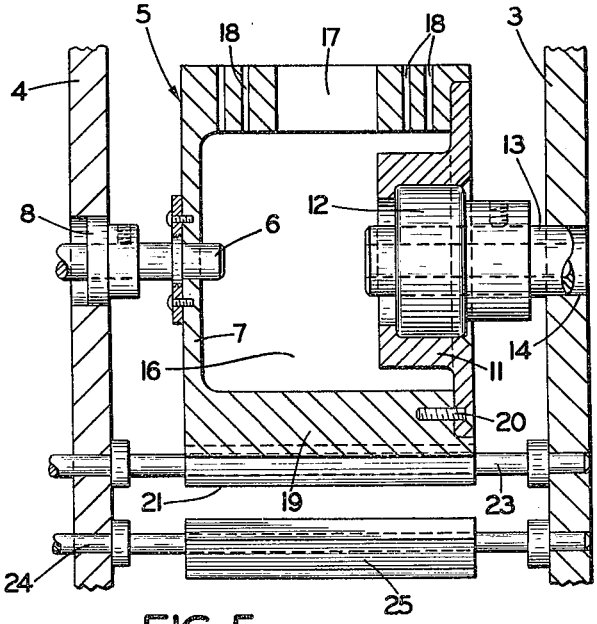
FIG. 5 is a fragmentary sectional view of the rotor taken on the line 5—5, FIG. 4.
Figure 6:
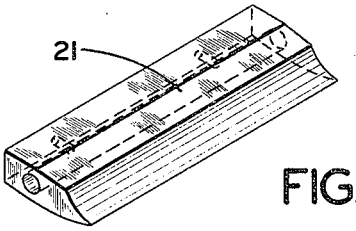
FIG. 6 is a perspective view of the bill peeler shown in FIGS. 1, 4 and 5.
Figure 7:
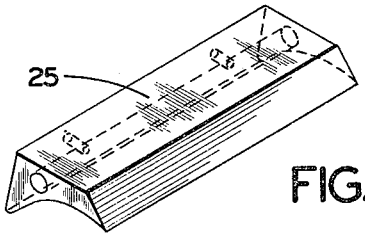
FIG. 7 is a similar view of the multiple bill rejector shown in FIGS. 1, 4 and 5.

A bill peeler 21 (FIGS. 4-6) is fixed by pin means 22 on a shaft 23 rotatably mounted in side support members 3 and 4 (FIG. 5). Another shaft 24 is journaled in side support members 3 and 4 below the bill peeler shaft 22 and has a multiple bill rejector member 25 fixed thereto by pin means 26 (FIGS. 4, 5, and 7). The construction and operation of bill peeler and multiple bill rejector 21 and 25 in cooperation with the hollow rotor 5 is described below.

Rotor drive gear 9 may be driven by a main drive belt 27 (FIGS. 2 and 11) engaging drive pinion 28 mounted on a drive shaft 29 suitably driven in the usual manner by a drive motor (not shown).

The magazine drive pinion 10 is engaged by a driving belt 30 which is trained around a drive gear 31 mounted on a cam shaft 32 (FIGS. 1, 2 and 11) which is journaled in bearings 33 and 34 mounted respectively in side support members 4 and 3. A magazine control cam 35 is mounted on cam shaft 32 (FIG. 3), the operation of which is described below.

Paper money bills 36 to be dispensed are stored in a stack or bundle in a magazine generally indicated at 37, best shown in FIGS. 1, 8, 9, 10, 11 and 15. The magazine 37 is formed with a storage compartment 38 by side walls 39, end walls 40 and 40*a*, bottom walls 41 and 41a, and a top wall 42.

The side walls 39 of magazine 37 have vertical slots 43 formed therein adjacent the generally vertical corners of the compartment 38 (FIG. 9), and slide rods 44 are mounted in the side walls 39 centrally of and extending the length of the slots 43. The slide rods 44 are engaged by and slidably mount and guide the ends of cross bar 45 mounted in spaced relation on the underside of pressure pad member 36, which is thus movably mounted within the storage compartment 38 vertically thereof.

Figure 9:
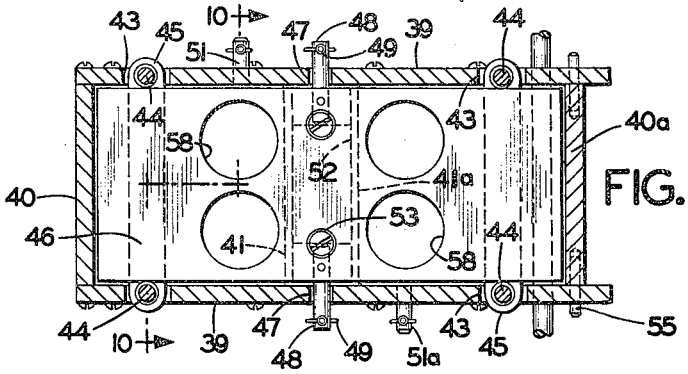
FIG. 9 is a sectional view of the bill magazine taken on the line 9—9, FIG. 8.

Central slots 47 also are formed in the magazine walls 39 spaced laterally between the vertical slots 43. Pins 48 extend through slots 47, along which the pins 48 are movable (FIG. 9). Tensioning springs 49 extend along either side of magazine 37 and springs 49 are connected at one end with the pins 48. The springs 49 are trained around idler pulleys 50, and the other spring ends are connected to fixed pins 51 and 51*a* projecting from the lower ends of the magazine side walls 39. The pins 48 are mounted on a U-shaped bracket 52 mounted by screws 53 on the underside of pressure pad member 46.

In this manner, pressure from the tension springs 49 is transmitted through the pins 48 to the pressure pad member 46 to urge it upwardly in the magazine storage compartment 38 in the direction of the arrow 54 at all times, thus pressing the paper money bills 36 stacked on member 46 upward in the magazine storage compartment 38 and against the top wall 42 of the magazine 37, as shown in FIGS. 1, 8, 11 and 15.

Access to the magazine storage compartment 38 for charging the compartment with a stack of paper money bills 36 may be gained by pivotally mounting end wall 40*a* of the magazine 37 at its lower end on pivot 55 (FIG. 11). End wall 40*a*, when closed, may be latched in position by a spring pressed ball latch 56 which engages in latch-engaging opening 57 formed in magazine side wall 39 (FIG. 11).

The pressure pad member 46 (FIGS. 9 and 10) may be reduced in weight by forming a series of holes 58 therein.

Figure 1:
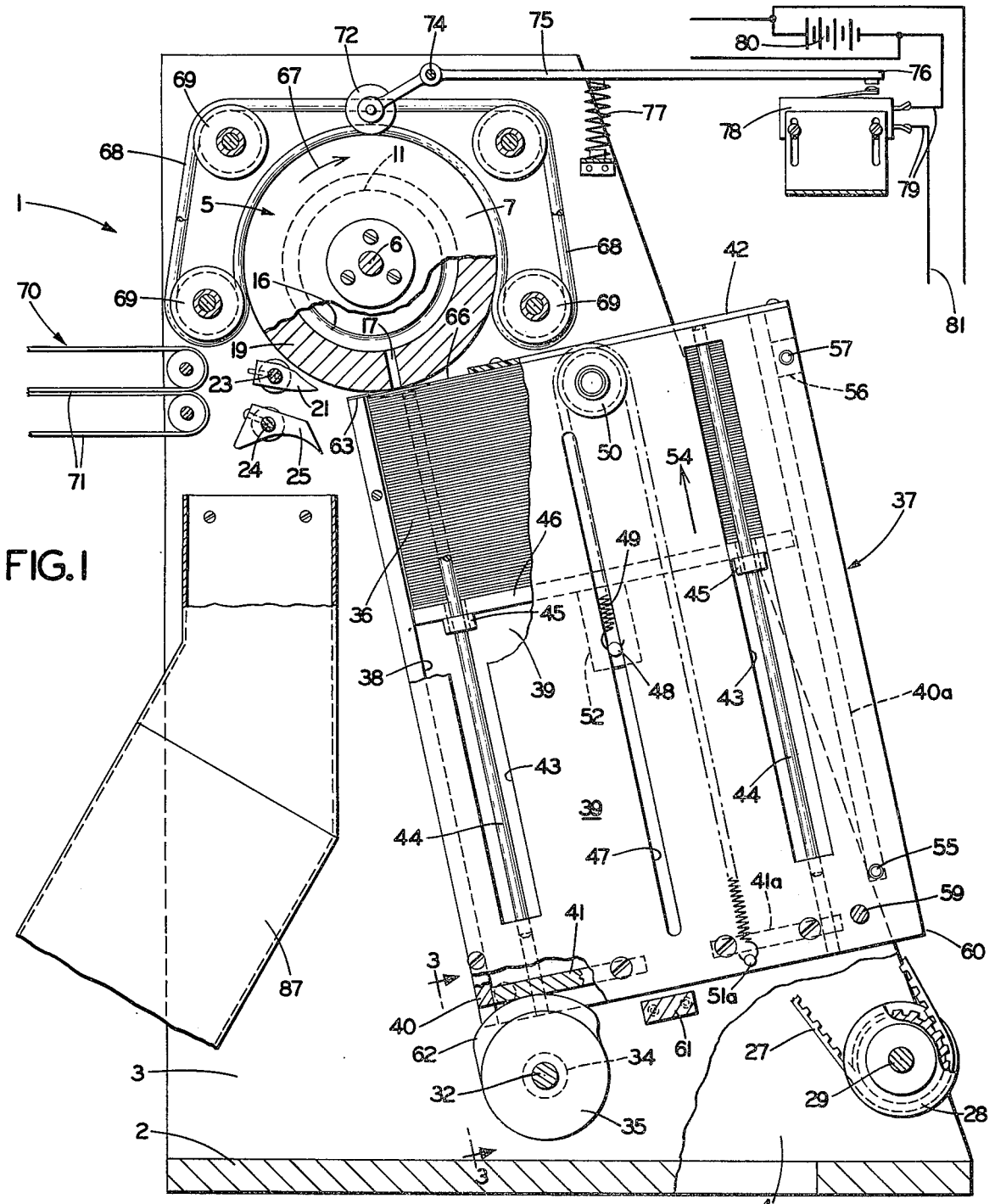
FIG. 1 is a somewhat diagrammatic vertical sectional view, taken on the line 1—1, FIG. 2, with parts broken away illustrating generally the magazine, rotor, conveyor and sensor components of the improved mechanism of the invention.
Figure 3:
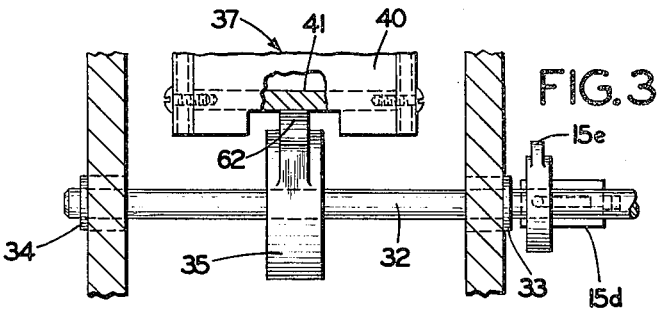
FIG. 3 is a fragmentary view looking in the direction of the arrows 3—3, FIG. 1, illustrating the control means for magazine movement.
Figure 8A:
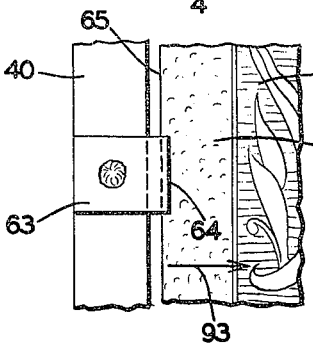
FIG. 8*a* is an enlarged fragmentary view looking in the direction of the arrows 8—8, FIG. 8.
Figure 8:
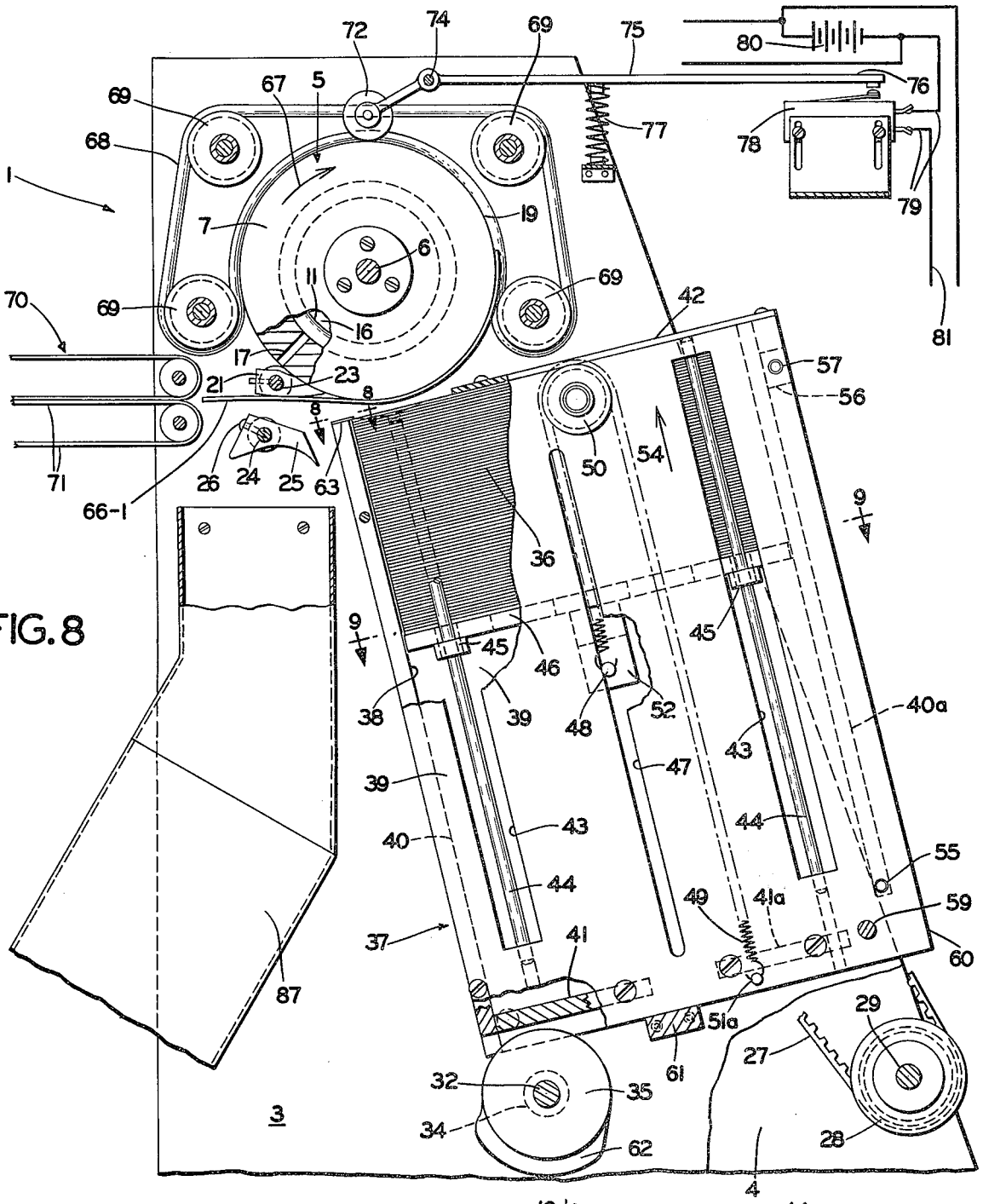
FIG. 8 is a view similar to FIG. 1 illustrating the rotor in position delivering a single bill endwise to the conveyor mechanism.
Figure 10:
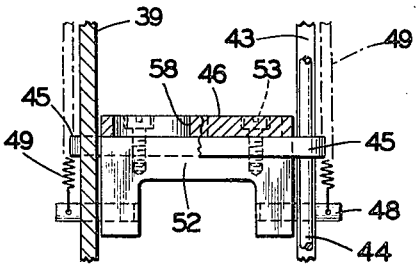
FIG. 10 is a fragmentary view, with parts removed, looking in the direction of the arrows 10—10, FIG. 9.

The magazine 37 is pivotally mounted at 59 adjacent its bottom right-hand corner 60 viewing FIG. 1 so that its top lefthand corner zone may be moved toward and away from the rotor 5 between the positions shown in FIGS. 1 and 8. Normally, the magazine 37 is in a "neutral" or down position shown in FIG. 8 with its bottom end resting on a stop member 61 mounted on and extending between the side support members 3 and 4. The magazine 37 is moved from the neutral position of FIG. 8 by pivoting the magazine clockwise around its pivot point 59 to a bill "pick-up" position shown in FIG. 1, by the operation of magazine control cam 35, the projecting cam surface 62 of which engages the magazine bottom wall member 41 (FIGS. 1 and 3) during a revolution of the cam shaft 32.

The bills 36 in magazine compartment 38 are not covered by the magazine top wall 42 at the top left-hand corner of the magazine, viewing FIGS. 1 and 8. When the magazine is moved to the bill pick-up position shown in FIG. 1, the exposed left-hand end area of the top bill 66 in the stack 36 engages rotor 5, as shown in FIG. 1, ready to be picked up by the rotor, as indicated below in describing the operation of the mechanism.

As stated above, when the magazine 37 is in the neutral position of FIG. 8, where it moves by gravity as soon as the magazine 37 is disengaged from the projecting cam surface 62 of magazine control cam 35, it is supported on stop member 61, out of engagement with the remainder of cam 35 beyond projecting cam surface 62. Thus, the magazine 37 and projecting cam surface 62 are only subject to wear during interengagement in moving between neutral and pick-up positions.

A bill detent 63 (FIG. 8a) is mounted on the top end of magazine end wall 40, and has an end 64 which projects laterally over the open end portion of bill compartment 38. Detent end 64 extends slightly over the left-hand end 65 of the top bill indicated at 66 in FIG. 8*a* in the stack 36 of bills contained in the magazine storage compartment 38, for a purpose to be later described.

During operation of the mechanism, described in more detail below, the top bill 66 in the stack 36 is picked up by vacuum through rotor slot 17 and openings 18 and is engaged by the rotor 5 as it rotates clockwise (FIG. 1) in the direction of the arrow 67. In order to securely hold the bill after pick-up by the rotor on and against the circumferential rotor surface as the rotor rotates, tensioned belts 68 are trained over a pulley system 69 and surround and engage preferably more than a semi-circular portion of the rotor, as shown in FIGS. 1, 2, 8, 11 and 15. These tensioned belts 68 securely hold the bill 66 against the circumferential surface of rotor 5 in the region when the belts 68 overlie the rotor.

It is important in the operation of the rotary bill pick-up unit 1 that bills 66 be picked up by the rotor 5 from the magazine 37, individually, singly, or one at a time and not in multiples.

Accordingly, since it is possible under any one of a number of circumstances for two bills to be picked up together by rotor 5, in accordance with the invention means is provided to sense a condition when multiple bills are picked up by the rotor during the rotor pick-up operation movement, and before any bills are delivered to other components of the mechanism, such as conveyor mechanism generally indicated at 70 which may comprise belt conveyors 71 leading to a bill counting zone and a dispense station.

Bill counters, multiple bill detectors, and multiple bill rejectors have been interrelated elements forming components of bill conveyors in prior devices. Separation of the multiple bill detecting and rejecting operations from the counting and conveying mechanisms avoids many complications in the construction, operation and control of bill counter and recorder devices which count and record the number of bills delivered to a dispense station.

Thus, the present invention contemplates the detection of multiple bill pick-up prior to delivery of bills to a conveyor, and, accordingly, contemplates associating multiple bill sensor means with the rotor and its operation. This is accomplished by mounting a sensor roller 72 at an end of lever means 73, pivoted at 74 and having an extended lever arm 75 to provide mechanical advantage and to amplify roller movement at the end 76 of lever arm 75 when roller 72 is moved away from the surface of the rotor 5 incident to encountering multiple thicknesses of bills rather than a single thickness thereof.

The lever means 73–75 is normally biased by spring 77 to maintain roller 72 in contact with the rotor 5 or a bill on the rotor surface. When roller 72 encounters multiple bills, it rotates lever means 73–75 clockwise about pivot 74, and the end 76 of lever arm 75 moves downwardly signaling that sensor roller 72 has detected multiple bills.

This signal, by movement of the lever arm end 76, may be converted to an electrical signal by engagement of the arm end 76 with, and actuation thereby of a microswitch 78 to close a circuit 79 energized by power 80. Closure of sensor control circuit 79 in a usual manner may energize a circuit 81 (FIGS. 2 and 11) to solenoid means 82 having an armature 83 connected with an actuating lever 84 mounted on shaft 24 to control positioning of multiple bill rejector member 25. Actuating lever 84 is normally biased by spring 85 to the neutral or open position of multiple bill rejector member 25 shown in FIGS. 1, 8 and 11.

Figure 14:
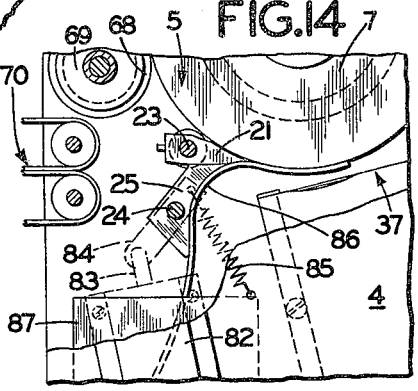
FIG. 14 is a somewhat diagrammatic sectional view of the rotor, bill peeler, multiple bill rejector, and rejector control mechanism in rejecting position to bypass multiple bills directly from the rotor to a reject station.
Figure 15:
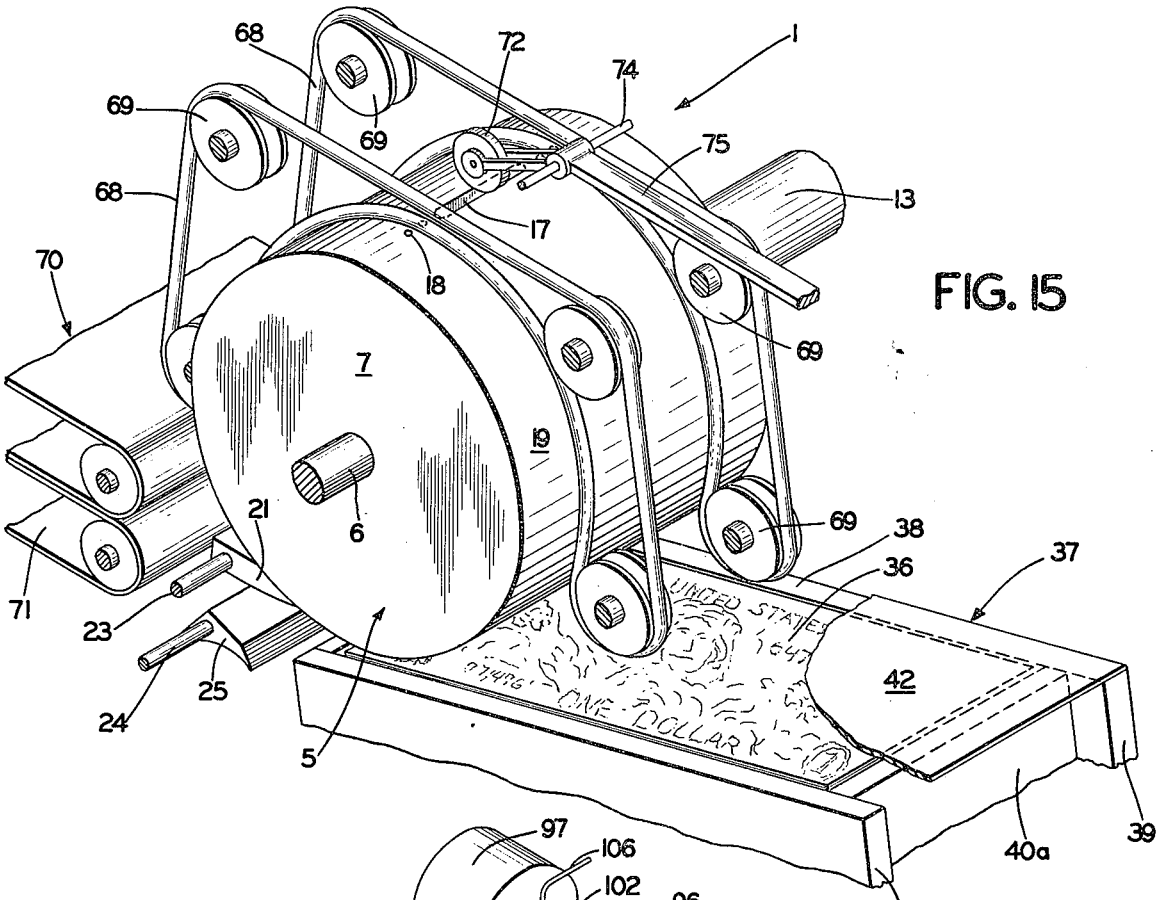
FIG. 15 is a somewhat diagrammatic perspective view of certain of the mechanism parts shown in FIGS. 1 and 2.

When the solenoid 82, by signal from the sensor roller 72 encountering multiple bills is energized, the solenoid armature 83 is moved to the position shown in FIG. 14, thereby rotating shaft 24 and moving multiple bill rejector member 25 to a "reject" position as shown in FIG. 14. In this reject position, multiple bills, two of which are shown by the double line 86 in FIG. 14, are bypass discharged directly from the rotor 5 to a reject chute 87 leading to a rejected multiple bill collector, not shown.

The actuation of the bill peeler 21 is shown in FIGS. 2, 11, 12 and 13. Shaft 6 which is power driven from the motor drive shaft 29 has a pinion 88 thereon just outside of side support member 4 (FIG. 2) which meshes with cam gear 89 (FIGS. 12 and 13) and is driven thereby. Cam gear 89 has a cam pin 90 which at a certain period during cam gear rotation, engages lever 91 (FIG. 13) mounted on bill peeler shaft 23. Lever 91 normally is biased to maintain bill peeler 21 is contact with rotor 5, as shown in FIGS. 4 and 8. However, when cam pin 90 engages lever 91, bill peeler 21 is disengaged from the rotor in the position shown in FIG. 1.

The initiation of a bill pick-up operation is shown in FIG. 1 when the suction slot 17 in rotor 5 is located, as shown, above the upper left-hand corner of the stack 36 of bills in magazine 37. At this time, the coordinated operation of the cam shaft 32 to engage the projecting cam surface 62 with magazine 37, has raised the magazine to the position shown in FIG. 1. At this time the top bill 66 in the magazine is in contact with the circumferential surface of rotor 5. Meanwhile, coordinated drive of cam gear 89 (FIG. 13) has engaged cam pin 90 with lever 91 to move bill peeler shaft 23 to the position shown in FIG. 1, wherein the bill peeler is out of contact with the rotor surface. When bill peeler control lever 91 is in the position of FIG. 12, disengaged from cam pin 90, bill peeler 21 engages rotor 5, as shown in FIGS. 4 and 8.

With FIG. 1 position, suction is applied through suction slot 17 and openings 18 to engage and pick up left-hand edge portion of top bill 66 in magazine 37. Suction on for slot 17 occurs on opening valve **15*a* on suction source connection 15 by actuating solenoid 15*b*, energized by power 80 and circuit 15c, closed by microswitch 15*d* actuated by cam 15*e* on shaft 32 coordinating with moving magazine 37 (FIGS. 2 and 3) by cam 62 on shaft 32. Closure of valve 15*a* provides suction off for slot 17**.

As rotor 5 rotates, top bill held by suction slot 17 wraps around the rotor surface. After the rotor has made one revolution or more from the position of FIG. 1 to that of FIG. 8, the bill that has been picked up, indicated at 66-1 is peeled from the rotor surface by bill peeler 23. Meanwhile, suction to the interior of the rotor preferably is cut off at this time; and cam 35 has moved to the position of FIG. 8, releasing magazine 37 whereupon the magazine moves to the position shown in FIG. 8 with the stack of bills 36 therein spaced from the rotor surface. Meanwhile, cam pin 90 has remained out of contact with lever 91 so that the bill peeler 21 is in the peeling position in contact with the rotor, as shown in FIGS. 4 and 8.

Continued rotor movement in the direction of the arrow 72 (FIG. 8) feeds bill 66-1 from the rotor to conveyor means 70 where it is handled, counted, etc. in the usual manner while being transported to a dispense station.

If more than one bill is picked up by the rotor at the position of the parts shown in FIG. 1, the multiple bills passing under roller 72 during rotation of rotor 5 actuates the sensor mechanism because of the multiple bill thickness. This signals the sensor signal circuit 79 which actuates solenoid 82 to move multiple bill reject member 25 to the position shown in FIG. 14. As shown in FIG. 14, the multiple bills 86 are peeled from the rotor 5 and bypassed from the conveyor 70 and are directed or discharged into the reject chute 87.

In the construction shown, the rotor makes two revolutions for each bill pick-up operation. The beginning of the second revolution of rotor 5 is shown in FIG. 8 as the bill 66-1 is being peeled from the rotor and fed to conveyor 70. The rotor in FIG. 8 continues to complete a second revolution when suction slot 17 has arrived at the position shown in FIG. 1 ready for another bill pick-up operation.

Meanwhile, shafts 32 and 23 operating, respectively, on the cam 35 and cam gear 89, by proper gear and belt drive ratios, only move one revolution while rotor 5 is making two revolutions. Thus movement is coordinated of the magazine 37 and of the bill peeler 21 relative to the rotor 5.

The action of the bill detent 63 with relation to the top bill 66 as it is being picked up by rotor 5 and suction slot 17 is important. There is a slight flexing of the forward edge portion of the bill 66, as it is engaged by suction through slot 17, and the suction draws the extreme edge of the bill slightly to the right momentarily in the direction of the arrow 93 shown in FIG. 8*a*. This tends to avoid multiple bill pick-up. As the left-hand end edge 65 of bill 66 is withdrawn from under the end 64 of bill detent 63, a characteristic snapping or flipping action occurs as it flips toward the surface of the rotor during continual rotor movement.

General Mode of Sequence of of Operation of Mechanism

Figure 17:
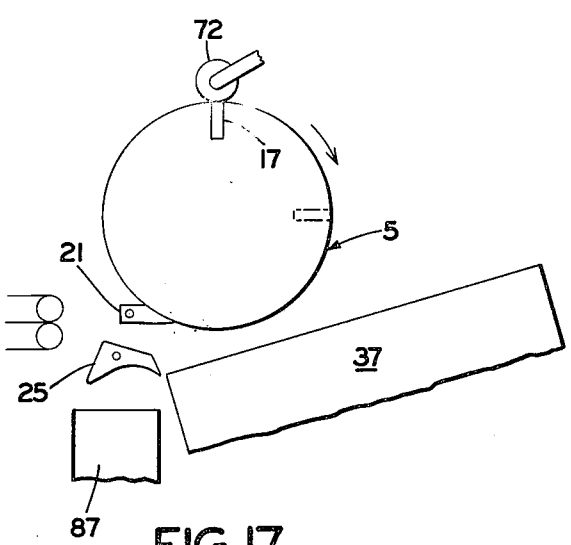
FIGS. 17–25 are a series of diagrammatic operational views illustrating the operation of the mechanism.

The sequential operation of the mechanism is shown diagrammatically in FIGS. 17 through 25. FIG. 17 shows the parts in neutral or at-rest position, at which time the vacuum slot 17 is in the twelve o'clock full line position. At this time, vacuum is turned off, and the magazine 37 is in down position. Operation of the mechanism is initiated by energizing the motor for main drive shaft 29 in any desired manner. As rotor 5 commences movement during the first of two revolutions involved for each bill pick-up operation, and when it has rotated through 90° to the dot-dash position of the vacuum slot 17 shown in FIG. 17, the vacuum is turned on.

Figure 18:
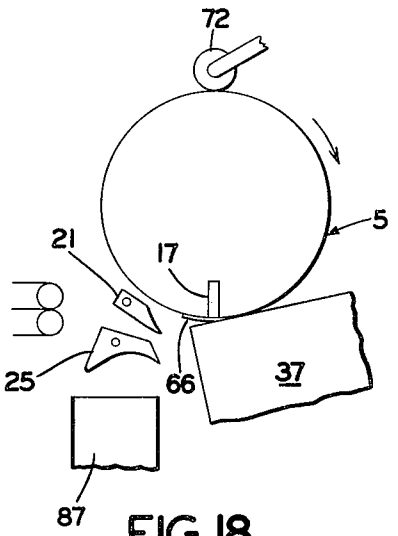

Continued rotor motion through another 90° to about a 6 o'clock location of the vacuum slot 17, locates the parts in the relative positions shown in FIG. 18. The bill peeler 21 is disengaged from drum 5, the magazine 37 is up, and vacuum slot 17 is engaged with the top bill 66 in magazine 37 and starts actual pick-up of the top bill.

Figure 19:
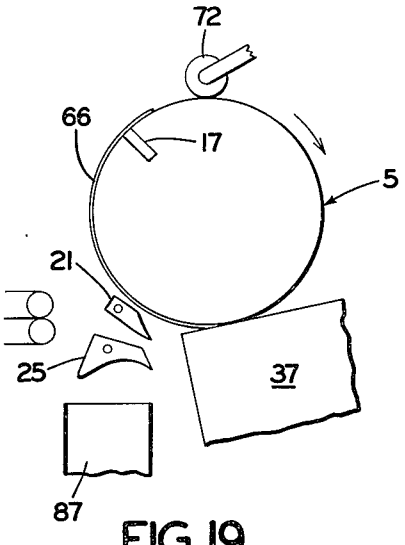

FIG. 19 shows another 135° movement of the rotor 5, with the picked-up bill 66 substantially completely withdrawn from magazine 37, the magazine still being in the "up" position.

Figure 20:
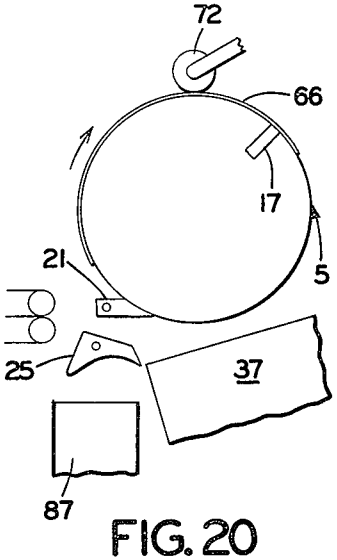

FIG. 20 shows the position of the parts after further 90° movement of the rotor 5. The magazine 37 has moved down, and the bill peeler 21 has moved to engage the rotor 5. Meanwhile, the bill has been gauged for thickness as described below.

Figure 21:
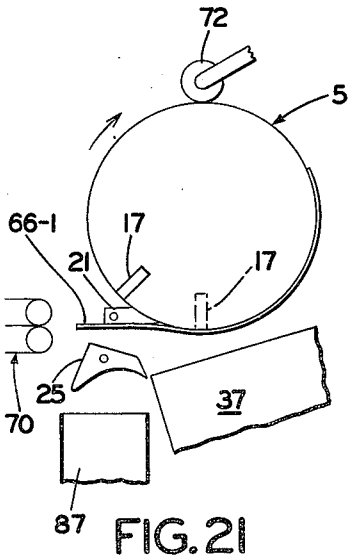

After further 135° movement of the rotor 5 and when the suction slot 17 is in .about the dot-dash position shown in FIG. 21, the vacuum is cut off. As the rotor moves another 45° to the full line suction slot 17 position shown in FIG. 21, the bill 66-1 is peeled by bill peeler 21 from the rotor 5 and is fed to a conveyor 70.

Figure 22:
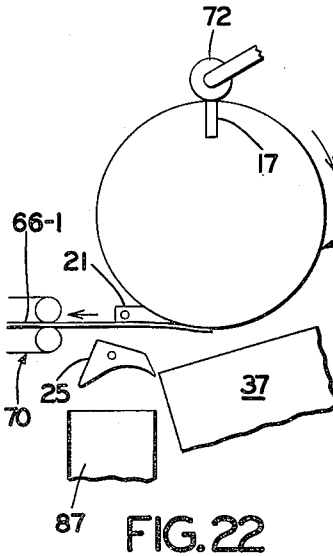

FIG. 22 shows the parts in the position at the completion of a second revolution of rotor 5. The parts again are in neutral position as in FIG. 17. At this time, the bill 66-1 is being conveyed from rotor 5 by conveyor 70. In this manner, a single bill pick-up and delivery operation has been completed. Similar subsequent operations may occur by actuation of the motor drive for the mechanism, in accordance with the number of bills desired to be picked up and dispensed, as called for, for example, by keying in an amount of money desired, in the keyboard of an automatic banking unit such as shown in our copending Rotary Cash Drawer Mechanism for Currency Dispenser application Ser. No. 445,236.

Figure 23:
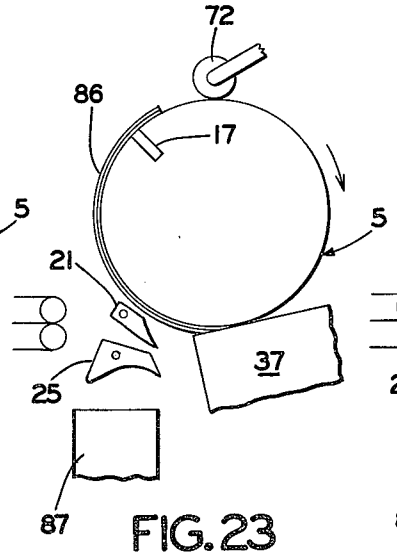
Figure 24:
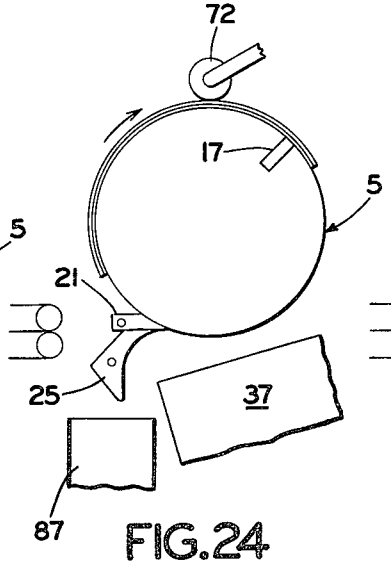
Figure 25:
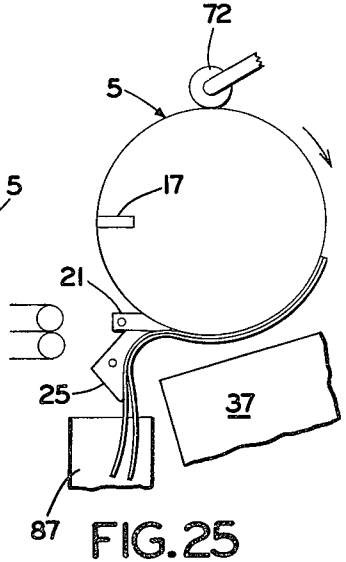

FIG. 23 shows the parts in a position similar to the position of the parts in FIG. 19 but shows the pick-up of multiple bills 86. As the rotor continues to rotate from the position of FIG. 23 to that of FIG. 24, the multiple bills 86 pass under the sensor roller 72 which is actuated in the manner described above. This results in moving the multiple bill rejector member 25 to the position shown in FIG. 24 to bypass the multiple bills 86 in the manner described as the rotor 5 continues to rotate through a second revolution as shown in FIG. 25 and as described above in connection with FIG. 14.

In General

The improved construction and operation of the bill pickup mechanism involve a number of important characteristics, facets and results. During a bill pick-up operation, a substantial portion of the entire leading edge of the bill 66 is engaged by the pick up suction in slot 17. The bill 66 is held securely on the outer surface of the drum 5 by belts 68 during the measuring or sensing operation to determine the bill thickness by the sensor roller 72. There is a large area of engagement, not only by the suction slot 17, but by the bill contact throughout its entire undersurface with the rotor while held securely by the tension belts 68, which imparts driving force to the bill while moving from the initial pick-up position, to the discharge position where fed to conveyor 70 (FIGS. 18 to 22).

The rotor 5 and the other components driven in synchronization with the rotor, may have relatively low speeds while at the same time satisfying requirements for bill delivery rates required for remote automatic banking equipment. The mechanism is compact, simple in construction and relatively inexpensive to manufacture, as compared with prior complicated bill pick-up mechanisms wherein the bills are stored on edge and are picked up by an oscillating sucker arm or nozzle.

Furthermore, because of the simple and compact construction of the mechanism, it may be securely housed in any desired safe-like structure for protecting the money contained in the magazine 37. The compactness, simplicity and security of the construction and operation is further characterized by a minimum number of moving parts and by considerable latitude or lack of criticality in the requirements for driving the mechanism, the speed thereof and for the supply and cut-off of vacuum. These requirements are not stringent.

In addition, the multiple bill sensing cooperative relation with the bill pick-up rotor is characterized by maximum effectiveness since the bill thickness is measured throughout the entire length of single or multiple bills passing under sensor roller 72 during rotor movement. Further, the multiple bill sensor mechanism utilizing a pivoted lever presents a simple and easy way of mechanically amplifying the thickness measurement made throughout the entire length of the bill.

The foregoing favorable characteristics and cooperative relationships not only contribute to a low cost of constructing the mechanism, but provide a simple mechanism having an adequate rate of output, and utilizing simple rotary motions; in place of mechanical oscillations of prior device elements which is desirable to avoid.

Finally, actual operation of the improved rotary bill pick-up mechanism has established the reliability of its operation. On-off suction operation is not necessary, and suction may be on when the equipment is operating, since bill peeler 21 will peel bills from rotor 5 whenever engaged with rotor 5.

Although there are advantages of the mechanical multiple bill sensor construction described, which permit amplification of bill thickness measurements to be utilized; nevertheless, photoelectric multiple bill detector devices, such as described in U.S. Pat. No. 3,760,158 may be used to project light beam means through bills and through openings in the walls of rotor 5 to measure bill opacity in excess of a predetermined value which will disclose the existence of more than one bill on the rotor surface at any one location.

Second Embodiment

Where it is desired to dispense bills of different denominations, such as 1, 5, 10 and 20 dollar bills, from an automatic banking currency dispenser, magazines containing the various denominations may be installed side by side; and the rotor pick-up mechanisms for such magazines may be aligned, as shown in FIG. 16 at 94, 95, 96 and 97, arranged to be driven by a common shaft 98 with clutches 99, 100, 101 and 102 for each of the respective rotors 94–97. A source of vacuum 103, 104, 105 and 106, respectively, is connected through rotary seals to the hollow rotors 94–97. The rotors may be energized by typical automatic banking unit actuation for delivery of the required number of bills of each denomination for a particular cash dispensing transaction in an automatic banking unit, such as shown in application Serial No. 445,236, now U.S. Pat. No. 3,880,320. The bills are delivered, respectively, to the conveyors 107, 108, 109 and 110, which in turn feed them to dispense chutes 111, 112, 113 and 114, respectively, as diagrammatically shown in FIG. 16. Chutes 111–114 in turn deliver the bills to a dispense station, such as a banking unit cash delivery drawer mechanism, for example, the rotary cash drawer mechanism shown in said application Ser. No. 445,236.

MISCELLANEOUS

Accordingly, the new paper money dispensing mechanism for picking up bills from a stored stack of bills in a magazine, and for sensing the presence or absence of multiple bills as picked up and before being delivered to a conveyor for counting, recording and delivery to a cash drawer, eliminates complicated and costly constructions required in prior devices, and provides a construction which achieves the objectives stated, avoids difficulties heretofore existing in the art which have been described, and solves problems and obtains the new results indicated.

In the foregoing description, certain terms have been used for brevity, clearness and understanding; but no unnecessary limitations are to be implied beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the new paper money dispenser mechanism is constructed and operated, and the advantageous, new and useful results obtained; the new and useful structures, devices, components, elements, arrangements, parts, combinations, systems, equipment, operations, and relationships are set forth in the appended claims.

We claim:

1. In paper money bill dispensing mechanism wherein bills are transferred from a stack of bills to adjacent conveyor means which delivers the bills to a dispense station, the combination of movably mounted magazine means storing a stack of bills;

rotary bill suction pick-up means including a rotor having a circumferential wall with an outer surface and elongated bill pick-up slot means formed in said wall;

main drive means for rotating the rotor;

the suction pick-up means including a source of suction having suction on communication with the slot means;

bill peeler means operatively connected with the main drive means normally engaged with the rotor and movable by the main drive means selectively to rotor disengaged position;

means for holding bills picked up by the rotor securely to said outer rotor surface at least during partial revolution of the rotor;

means operatively connected with the main drive means and magazine means for moving the magazine means from a normal rotor disengaged position to a position engaging an end portion of the top bill in the stack stored in said magazine means with said outer rotor surface; and the operative connections between the main drive means, bill peeler means, and magazine means, being synchronized with suction on, to establish related conditions of bill peeler means disengaged position, and engaged magazine means position to engage an end portion of said top bill with the outer rotor surface;

whereby during rotor rotation the pick-up means withdraws the top bill from the stack when said top bill is engaged by the slot means and the withdrawn bill wraps around and is held to the outer rotor surface.

2. The construction defined in claim 1 in which the operative connections, upon a bill being picked up and withdrawn from the stack by the rotor, are synchronized to establish other related conditions of normal peeler means rotor engaged position, and normal magazine means disengaged position;

whereby during continued rotation of the rotor as said end portion of the picked-up bill reaches the rotor engaged peeler means, the bill is peeled from the rotor and discharged to adjacent conveyor means.

3. The construction defined in claim 2 in which the top bill in the stack is withdrawn endwise from the stack, is wrapped endwise around and held to the outer rotor surface, and is discharged endwise to adjacent conveyor means as a single bill; and in which single bills are successively discharged to said conveyor means during continued rotor rotation.

4. The construction defined in claim 1 in which the rotary bill suction pick-up means includes walls forming a hollow rotor having an axis and a suction compartment;

in which said circumferential wall constitutes one of said rotor walls;

in which said bill pick-up slot means communicates with the compartment and is oriented generally in the direction of the rotor axis; and in which means operatively actuated by the main drive means selectively established suction on and off communication with the slot means.

5. The construction defined in claim 4 in which the operative actuation of the suction means by the main drive means includes means operatively connected with the main drive means establishing intermittent communication between the suction source and the compartment whereby the conditions of suction on and suction off are selectively established.

6. The construction defined in claim 1 in which the bill peeler means engages the outer rotor surface when normally engaged with the rotor.

7. The construction defined in claim 1 in which multiple sensor-rejector means is operatively related to the rotor for sensing the absence or presence on the outer rotor surface of multiple bills picked up in multiple by the rotor; and in which the sensor-rejector means is operative to bypass multiple bills picked up in multiple to a reject station before delivery of multiple bills in multiple to adjacent conveyor means.

8. The construction defined in claim 7 in which the sensor-rejector means is operative to sense the absence or presence on the rotor surface of multiple bills picked up in multiple by the rotor while such picked-up bills are held securely to said outer rotor surface by said bill holding means.

9. The construction defined in claim 8 in which the bill holding means is operative to hold bills securely on the outer rotor surface at least during the multiple bill sensing operation of the multiple bill sensor-rejector means.

10. The construction defined in claim 7 in which the operative connections, upon a bill being picked up from and withdrawn from the stack by the rotor, are synchronized to establish other related conditions of normal peeler means rotor engaged position, and normal magazine means disengaged position; and in which said other related conditions are established after a bill picked up by the rotor has been sensed by the multiple sensor-rejector means.

11. The construction defined in claim 10 in which during continued rotation of the rotor and when the bill sensorrejector means has sensed the absence on the rotor surface of multiple bills, as an end portion of the picked-up bill on the rotor reaches the rotary engaged peeler means, the bill is peeled from the rotor and discharged to adjacent conveyor means.

12. The construction defined in claim 7 in which the multiple bill sensor-rejector means includes a bill rejector member pivotally mounted adjacent the rotor and movable to a position engaging the bill peeler means when the latter is engaged with the rotor to bypass to a reject station multiple bills picked up in multiple.

13. The construction defined in claim 12 in which the multiple bill sensor-rejector means includes lever means having bill thickness measuring means engagable with bills on the rotor;

in which said lever means includes means amplifying the bill thickness measurement; and in which said lever amplifying means is operative upon measurement of more than one bill thickness to actuate said pivoted rejector member to bill reject position.

14. The construction defined in claim 1 in which the magazine means is pivotally mounted adjacent the rotor for movement from a normal rotor disengaged position toward the rotor;

in which the means operatively connected with the main drive means and magazine means for moving the magazine means from normal position, includes a cam shaft and cam means on the cam shaft having a cam projection engageable with the magazine means for moving the latter from normal position to the position engaging an end portion of the top bill in the stack with the outer rotor surface; and in which the magazine means is normally biased on its pivotal mounting away from the rotor, and is held out of engagement with the cam means when the cam projection is disengaged from the magazine means.

15. The construction defined in claim 1 in which the magazine means includes a storage compartment formed by side, end, bottom and top walls;

in which a pressure pad is slidably mounted within the storage compartment for movement biased toward the top wall to push a stack of bills stored in the magazine means on the pressure pad toward and into engagement with the magazine top wall; and in which the top wall is shorter than the bottom wall to expose an end portion of the top bill in the stack at a top corner of the magazine means.

16. The construction defined in claim 15 in which detent means is mounted on one of the end walls at said exposed end portion of the top bill in the magazine means; and in which the detent means projects slightly over and engages an end edge of the top bill in the stack to control pickup of said top bill from the magazine means by the rotor.

17. The construction defined in claim 1 in which the bill peeler means includes a bill peeler member pivotally mounted adjacent the rotor and movable between positions engaged with and disengaged from the outer rotor surface;

in which cam means is operatively connected with the main drive means;

in which a lever is connected to the pivotal mounting of the peeler member normally biasing the peeler member into engagement with the rotor; and in which the cam means engages the lever to disengage the peeler member from the rotor.

18. The construction defined in claim 13 in which the bill sensor-rejector means includes switch means actuated by the lever amplifying means; and in which the pivoted rejector member is actuated by solenoid means normally biased away from bypass position and operative on energizing the solenoid by actuation of said switch means by the lever amplifying means to move the pivoted rejector member to bill reject position.

19. The construction defined in claim 1 in which the magazine means stores a stack of bills in a generally vertically oriented stack with the end portion of the top bill in the stack oriented below the rotor generally parallel with the rotor axis.

20. In paper money bill dispensing mechanism wherein bills are transferred from a stack of bills to adjacent conveyor means which delivers the bills to a dispense station, the combination of movably mounted magazine means storing a stack of bills;

rotary bill suction pick-up means including a rotor having a circumferential wall with an outer surface and elongated bill pick-up slot means formed in said wall;

main drive means for rotating the rotor;

the suction pick-up means including suction means operatively actuated by the main drive means selectively to suction on and off communication with the slot means;

bill peeler means operatively connected with the main drive means normally engaged with the rotor and movable by the main drive means selectively to rotor disengaged position;

means for holding bills picked up by the rotor securely to said outer rotor surface at least during partial revolution of the rotor;

means operatively connected with the main drive means and magazine means for moving the magazine means from a normal rotor disengaged position to a position engaging an end portion of the top bill in the stack stored in said magazine means with said outer rotor surface; and the operative connections between the main drive means, bill peeler means, magazine means, and suction means, being synchronized to establish related conditions of suction on, and bill peeler means disengaged position, when the magazine means is moved to engage an end portion of said top bill with the outer rotor surface;

whereby during rotor rotation the pick-up means withdraws the top bill from the stack when said top bill is engaged by the slot means and the withdrawn bill wraps around and is held to the outer rotor surface.

* * * * *